US007672634B2

(12) United States Patent
Lofthus et al.

(10) Patent No.: US 7,672,634 B2
(45) Date of Patent: Mar. 2, 2010

(54) ADDRESSABLE FUSING FOR AN INTEGRATED PRINTING SYSTEM

(75) Inventors: Robert M. Lofthus, Webster, NY (US); Eric S. Hamby, Fairport, NY (US); Kristine A. German, Webster, NY (US)

(73) Assignee: Xerox Corporation, Norwalk, CT (US)

( * ) Notice: Subject to any disclaimer, the term of this patent is extended or adjusted under 35 U.S.C. 154(b) by 0 days.

(21) Appl. No.: 10/999,450

(22) Filed: Nov. 30, 2004

(65) Prior Publication Data

US 2006/0115306 A1 Jun. 1, 2006

(51) Int. Cl.
*G03G 15/20* (2006.01)

(52) U.S. Cl. ..... 399/341; 399/67

(58) Field of Classification Search ..... 399/341, 399/45, 67; 219/216
See application file for complete search history.

(56) References Cited

U.S. PATENT DOCUMENTS 4,579,446 A 4/1986 Fujino et al.
4,587,532 A 5/1986 Asano
4,591,884 A * 5/1986 Miyamoto et al.
4,791,447 A 12/1988 Jacobs
4,928,148 A 5/1990 Higashi
5,019,869 A 5/1991 Patton
5,053,828 A 10/1991 Ndebi et al.
5,241,155 A 8/1993 Koh et al.
5,258,809 A * 11/1993 Wiedemer
5,296,904 A 3/1994 Jackson
5,326,093 A 7/1994 Sollitt
5,402,220 A 3/1995 Tanaka et al.
5,436,710 A 7/1995 Uchiyama
5,436,712 A 7/1995 Wayman et al.
5,459,561 A 10/1995 Ingram
5,489,969 A 2/1996 Soler et al.
5,506,671 A * 4/1996 Buts et al.
5,568,246 A 10/1996 Keller et al.
5,570,172 A 10/1996 Acquaviva
5,596,416 A 1/1997 Barry et al.
5,678,133 A 10/1997 Siegel
5,848,331 A 12/1998 Fromm
5,890,032 A 3/1999 Aslam et al.
5,918,089 A 6/1999 Malinich et al.
5,995,721 A 11/1999 Rourke et al.
6,088,565 A * 7/2000 Jia et al.
6,101,345 A 8/2000 Van Goethem et al.
6,101,364 A * 8/2000 Boehmer et al.

(Continued)

*Primary Examiner*—David M Gray
*Assistant Examiner*—Laura K Roth
(74) *Attorney, Agent, or Firm*—Fay Sharpe LLP; Eugene O. Palazzo

(57) ABSTRACT

A printing system (10) includes at least one marking device (22A, 22B, 22C, 22D). Each of the marking devices is configured for applying images to print media. A primary fusing device (24A, 24B, 24C, 24D) is associated with each of the marking devices for applying a primary fusing treatment to the applied images to form printed media. A portion of the printed media may be only partially fused in the primary fusing treatment. A secondary fusing device (26) receives the printed media from the at least one marking device. The secondary fusing device and/or primary fusing device is addressable. A control system (90) may be operably coupled with the secondary fusing device. The control system evaluates whether the printed media is only partially fused and instructs the secondary fusing device to apply a further fusing treatment to the printed media evaluated as being only partially fused.

26 Claims, 7 Drawing Sheets

U.S. PATENT DOCUMENTS 6,393,245 B1 5/2002 Jia et al.
6,466,750 B2 10/2002 McIntyre
6,487,388 B2 11/2002 Theodoulou et al.
6,512,914 B2 1/2003 Kabashima
6,535,712 B2 * 3/2003 Richards
6,554,276 B2 4/2003 Jackson et al.
6,559,878 B2 5/2003 McIlvaine et al.
6,600,895 B2 7/2003 Fletcher et al.
6,607,320 B2 8/2003 Bobrow et al.
6,615,018 B2 * 9/2003 Funato
6,626,110 B1 9/2003 Ketter
6,647,239 B2 11/2003 Oberhoffner
6,650,863 B2 11/2003 Fuma
6,654,136 B2 11/2003 Shimada
6,661,993 B2 12/2003 Bartscher et al.
6,671,486 B1 12/2003 Fletcher
6,687,479 B2 2/2004 Leute et al.
6,721,518 B2 4/2004 Oshida et al.
6,725,010 B1 4/2004 Parker
6,744,527 B1 6/2004 Dorsey et al.
6,745,000 B2 6/2004 Pirwitz
6,757,514 B2 6/2004 Berkes et al.
6,784,027 B2 8/2004 Streubel et al.
6,795,661 B2 * 9/2004 Kanesawa et al. ..... 399/67
6,973,286 B2 * 12/2005 Mandel et al.
6,980,762 B2 12/2005 Bogoshian
6,985,691 B2 * 1/2006 Kodera et al. ..... 399/341
7,072,610 B2 7/2006 Nakane
7,197,271 B2 3/2007 Nakamura et al.
7,226,158 B2 6/2007 Moore et al.
2002/0191992 A1 * 12/2002 Funato
2003/0180063 A1 * 9/2003 Kanesawa et al.
2003/0228181 A1 12/2003 Fletcher
2004/0037598 A1 * 2/2004 Behnke et al.
2004/0081489 A1 * 4/2004 Noya et al. ..... 399/341
2004/0096250 A1 * 5/2004 Kito et al. ..... 399/341
2004/0114976 A1 6/2004 Weber et al.
2004/0155395 A1 8/2004 Milillo et al.
2004/0179201 A1 * 9/2004 Schneider et al.
2005/0158089 A1 * 7/2005 Amarakoon ..... 399/341
2006/0034631 A1 * 2/2006 Lofthus et al.
2006/0067757 A1 3/2006 Anderson et al.
2006/0114313 A1 6/2006 Moore
2006/0115305 A1 6/2006 Lofthus
2006/0221362 A1 10/2006 Julien
2006/0290760 A1 12/2006 German et al.
2007/0071465 A1 3/2007 Hamby et al.

* cited by examiner

ADDRESSABLE FUSING FOR AN INTEGRATED PRINTING SYSTEM

CROSS REFERENCE TO RELATED APPLICATIONS

Reference is made to commonly-assigned copending U.S. patent application Ser. No. 10/953,953, filed Sep. 29, 2004, entitled CUSTOMIZED SET POINT CONTROL FOR OUTPUT STABILITY IN A TIPP ARCHITECTURE, by David G. Anderson et al.; copending U.S. patent application Ser. No. 11/235,979, filed Sep. 27, 2005, entitled PRINTING SYSTEM WITH MULTIPLE OPERATIONS FOR FINAL APPEARANCE AND PERMANENCE, by David G. Anderson et al.; copending U.S. patent application Ser. No. 11/236,099, filed Sep. 27, 2005, entitled PRINTING SYSTEM WITH MULTIPLE OPERATIONS FOR FINAL APPEARANCE AND PERMANENCE, by David G. Anderson et al.; copending U.S. patent application Ser. No. 11/000,158, filed Nov. 30, 2004, entitled GLOSSING SYSTEM FOR USE IN A TIPP ARCHITECTURE, by Bryan J. Roof et al.; copending U.S. patent application Ser. No. 11/000,258, filed Nov. 30, 2004, entitled GLOSSING SYSTEM FOR USE IN A TIPP ARCHITECTURE, by Bryan J. Roof et al., and copending U.S. patent application Ser. No. 11/000,168, filed Nov. 30, 2004, entitled ADDRESSABLE FUSING AND HEATING METHODS AND APPARATUS, by Robert M. Lofthus, et al.; the disclosures of all of which are incorporated herein in their entireties, by reference.

BACKGROUND

The present embodiment relates to fusing of printed media. It finds particular application in conjunction with an integrated printing assembly in which marked media from a plurality of marking devices is directed to an addressable fusing system for selectively applying a secondary fusing treatment to the media and will be described with particular reference thereto. However, it is to be appreciated that the present embodiment is also amenable to other like applications.

In a typical xerographic marking engine, such as a copier or printer, a photoconductive insulating member is charged to a uniform potential and thereafter exposed to a light image of an original document to be reproduced. The exposure discharges the photoconductive insulating surface in exposed or background areas and creates an electrostatic latent image on the member, which corresponds to the image areas contained within the document. Subsequently, the electrostatic latent image on the photoconductive insulating surface is made visible by developing the image with a developing material. Generally, the developing material comprises toner particles adhering triboelectrically to carrier granules.

The developed image is subsequently transferred to a print medium, such as a sheet of paper. The fusing of the toner onto paper is generally accomplished by applying heat to the toner with a heated roller and application of pressure. In multi-color printing, successive latent images corresponding to different colors are recorded on the photoconductive surface and developed with toner of a complementary color. The single color toner images are successively transferred to the copy paper to create a multi-layered toner image on the paper. The multi-layered toner image is permanently affixed to the copy paper in the fusing process.

Another approach employed to fuse toner to paper is to apply a high-intensity flash lamp to the toner and paper in a process known as "flash fusing."

The fusing process serves two functions, namely to attach the image permanently to the sheet and to achieve a desired level of gloss.

Systems which employ several small marking engines are now being developed. These systems enable high overall outputs to be achieved by printing portions of the same document on multiple printers. Such systems are commonly referred to as "tandem engine" printers, "parallel" printers, or "cluster printing" (in which an electronic print job may be split up for distributed higher productivity printing by different printers, such as separate printing of the color and monochrome pages). These systems have been designed primarily for the office market. As xerographic marking engines are now used for a variety of different applications, the requirement for printing on media of varying substrate weight and surface roughness has increased. Coated stock is widely used in the graphics art industry, which increasingly relies on xerographic marking engines.

However, current xerographic marking engines are generally optimized for a particular type of paper and thus may be unable to fuse other substrates without a significant slowing in productivity. Fusing tends to impart curl to the paper, which can cause paper jams downstream of the fuser. Additionally, paper jams and printer damage can occur when the paper finish is not fully compatible with the fusing process. The fusing devices often have a limited lifetime because they are unable to maintain the high surface smoothness required for high gloss levels at typical fuser operating temperatures.

BRIEF DESCRIPTION

Aspects of the present disclosure in embodiments thereof include a printing system and a method of printing. The printing system includes at least one marking device for applying images to print media. A primary fusing device is associated with each of the marking devices for applying a primary fusing treatment to the applied images exiting the at least one marking device. A secondary fusing device receives printed media from the at least one marking device and applies a further fusing treatment to the applied images thereon. At least one of the primary fusing devices and the secondary fusing device includes an array of selectively actuable energy generating elements.

The method includes applying images to print media and applying a primary fusing treatment to the applied images to form printed media. A secondary fusing treatment is applied to the printed media. At least one of the primary and secondary fusing treatments includes selectively addressing a plurality of independently addressable energy generating elements.

The term "marking device" or "printer," as used herein broadly encompasses a device for applying an image to print media.

A "printing assembly," as used herein incorporates a plurality of marking devices, and may include other components, such as finishers, paper feeders, and the like and encompasses copiers and multifunction machines, as well as assemblies used for printing.

A "print job" or "document" is normally a set of related sheets, usually one or more collated copy sets copied from a set of original print job sheets or electronic document page images, from a particular user, or otherwise related.

The term "print medium" herein refers to a usually flimsy physical sheet of paper, plastic, or other suitable physical print media substrate for images, whether precut or web fed.

The term "fusing" incorporates both fixing (an attachment of the image to the print media) and appearance modification (primarily, modification of a gloss value of the printed media). In a fusing treatment, either one or both of fixing and appearance modification may be affected.

DETAILED DESCRIPTION

A printing system may include one or a plurality of marking devices which supply printed media, such as sheets, to a common fusing device. In one embodiment, the common fusing device is a secondary fusing device which augments the fusing performance of primary fusing devices resident in the marking devices. The extent to which an image is fused is generally a function of energy applied (typically in the form of heat), pressure applied, and dwell time (the time period during which the energy and/or pressure is applied).

Each of the marking devices includes an image forming component capable of forming an image on print media. A primary fusing device receives the imaged media from the image forming component and fixes the toner image transferred to the surface of the print media substrate, for example, by applying one or more of energy, such as heat via conduction, convection, and/or radiation, and/or other forms of electromagnetic radiation; pressure; electrostatic charges; and sound waves, to form a copy or print. The toner is imaged and if not totally fused, at least tacked to the media in the separate marking devices. The marking devices can then feed the imaged media to the secondary fusing device for any final fusing and gloss enhancement.

The printing system may incorporate "tandem engine" printers, "parallel" printers, "cluster printing," "output merger," or "interposer" systems, and the like, as disclosed, for example, in U.S. Pat. Nos. 4,579,446; 4,587,532; 5,489,969 5,568,246; 5,570,172; 5,596,416; 5,995,721; 6,554,276, 6,654,136; 6,607,320, and in copending U.S. application Ser. No. 10/924,459, filed Aug. 23, 2004, for Parallel Printing Architecture Using Image Marking Engine Modules by Mandel, et al., and application Ser. No. 10/917,768, filed Aug. 13, 2004, for Parallel Printing Architecture Consisting of Containerized Image Marking Engines and Media feeder Modules, by Robert Lofthus, the disclosures of all of these references being incorporated herein by reference. A parallel printing system feeds paper from a common paper stream to a plurality of printers, which may be horizontally and/or vertically stacked. Printed media from the various printers is then taken from the printer to a finisher where the sheets associated with a single print job are assembled. Variable vertical level, rather than horizontal, input and output sheet path interface connections may be employed, as disclosed, for example, in U.S. Pat. No. 5,326,093 to Sollitt.

Exemplary fusing systems which may be employed as the primary and/or secondary fusing device are described, for example, in U.S. Pat. Nos. 5,296,904; 5,848,331; 6,487,388; 6,725,010; 6,757,514; the disclosures of which are incorporated herein in their entireties, by reference.

Figure 1:
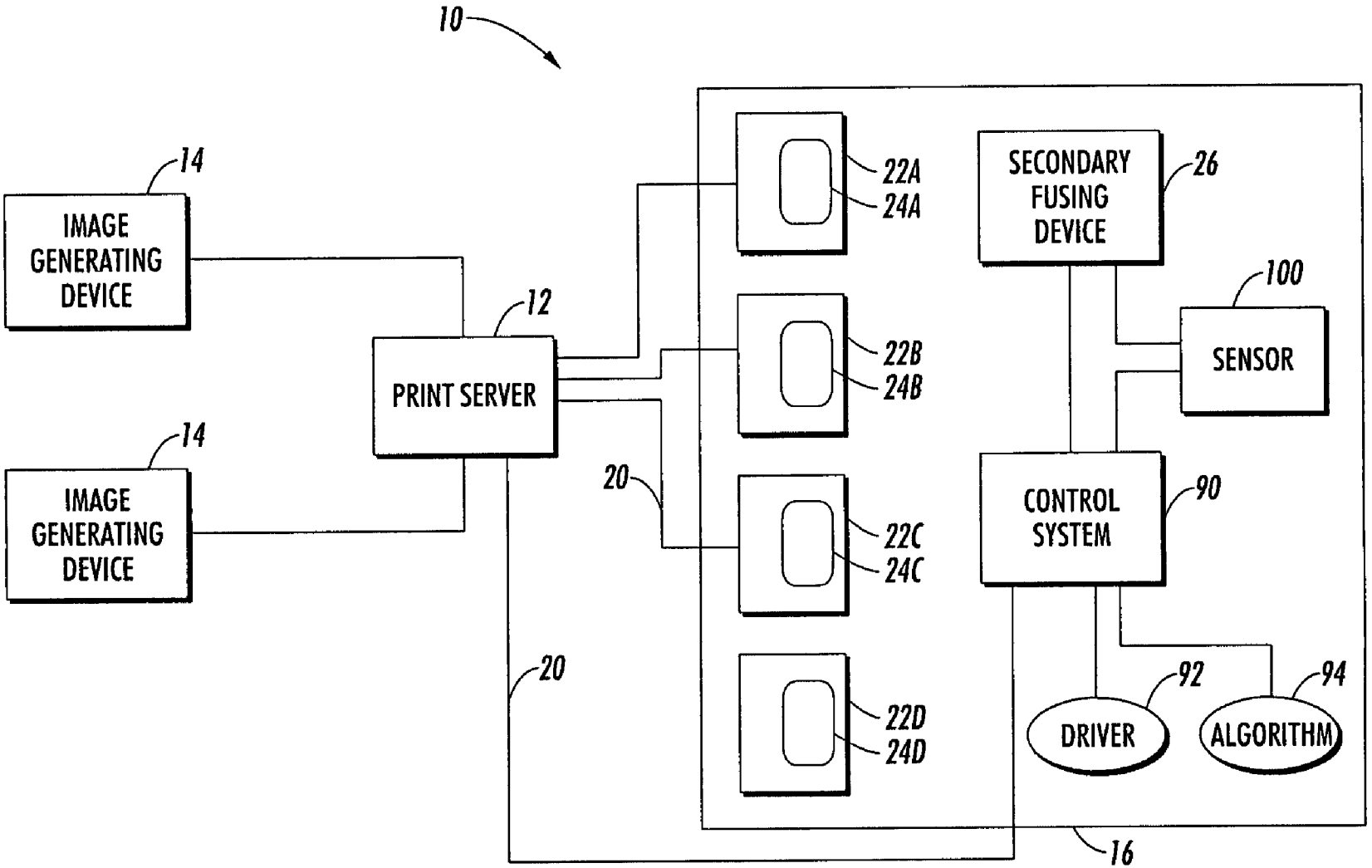
FIG. 1 is a schematic view of a printing system.

With reference to FIG. 1, an exemplary printing system 10 includes a print server 12, which receives image data from a computer network, scanner, digital camera, or other image generating device 14, and a printing assembly 16 capable of printing onto a print medium, all interconnected by links 20. The links 20 can be a wired or wireless link or other means capable of supplying electronic data to and/or from the connected elements. The printing assembly 16 includes a plurality of marking devices 22, each with an integral or associated primary fusing device 24. The printing assembly 16 also includes a secondary fusing device 26, which serves as a final appearance and permanence (FAP) module. While the marking devices are exemplified, in the illustrated embodiment, by four printers 22A, 22B, 22C, and 22D, each with a respective primary fusing device 24A, 24B, 24C, and 24D, it will be appreciated that fewer or more than four printers may be employed, such as one, two, five, or six printers.

Figure 2:
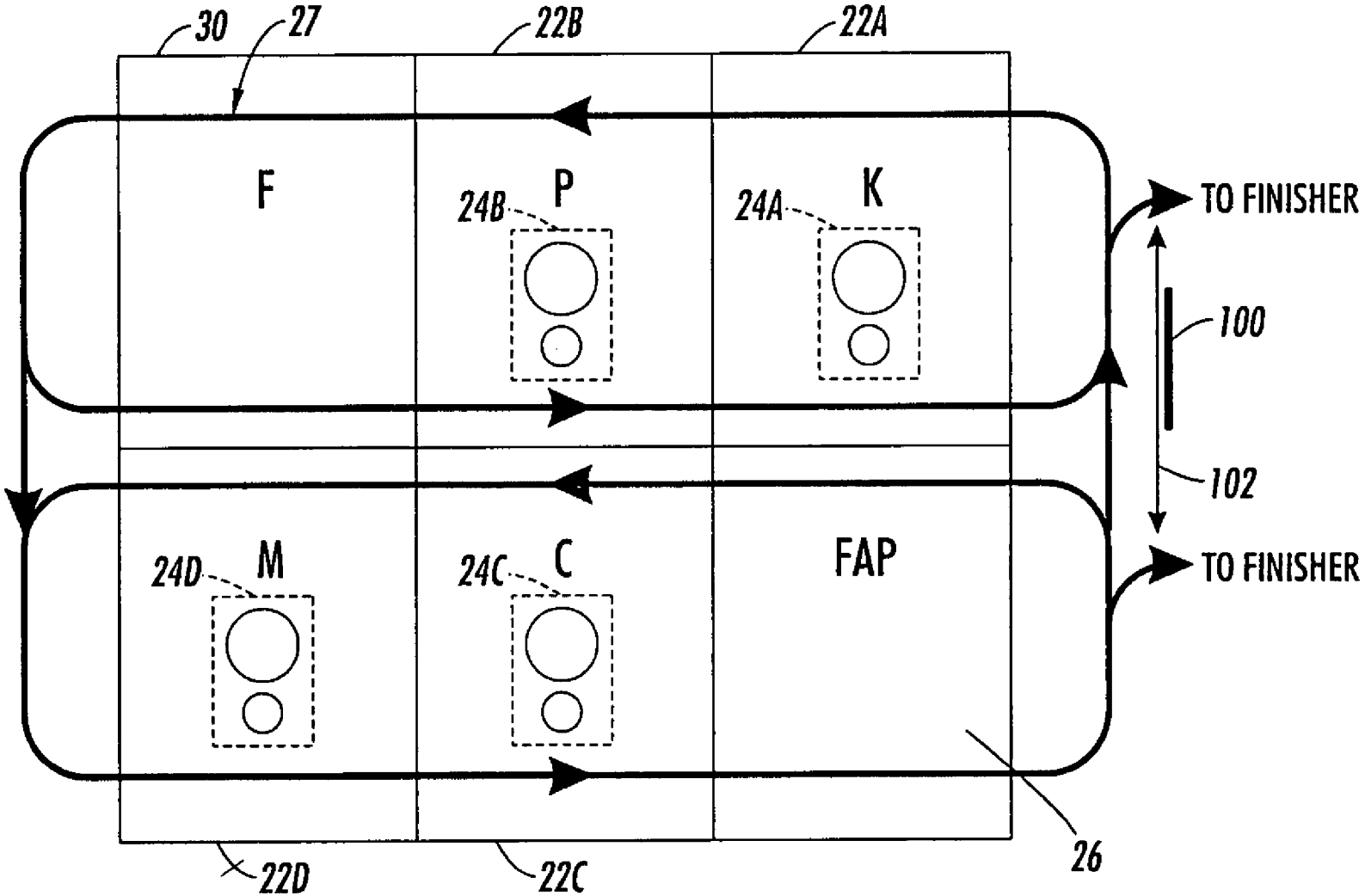
FIG. 2 is a schematic view of a first embodiment of a printing assembly for the printing system of FIG. 1.

With reference now to FIG. 2, an exemplary printing assembly 16 consists of several identical or different parallel printers 22A, 22B, 22C, and 22D, connected through a print media transporting system 27, such as a network of flexible paper pathways, that feeds to and collects from each of the printers. The print media transporting system 27 may comprise drive members (not illustrated), such as pairs of rollers, spherical nips, air jets, or the like. The system 27 may further include associated motors for the drive members, belts, guide rods, frames, etc. (not shown), which, in combination with the drive members, serve to convey the print media along selected pathways at selected speeds. FIG. 2 shows only the main highways for simplicity. In the illustrated embodiment, these highways are in the form of loops, which include downstream and upstream portions, by which the printers can be accessed, in any order, by the print media. However, other architectures are also contemplated.

Suitable printers 22 include electrophotographic printers, ink-jet printers, including solid ink printers, and other devices capable of marking an image on a substrate. The printers may be of the same modality (e.g., black (K), custom color (C), process color (P), or magnetic ink character recognition (MICR) (M)) or of different print modalities. In the illustrated embodiment, printer 22A prints black, 22B, process color, 22C, custom color, and 22D, MICR. Marking devices may be capable of generating more than one type of print modality, for example, black and process color. The printers are operatively connected for printing images from a common print job stream. At any one time, a plurality of the printers can each be printing. More than one of the printers can be employed in printing a single print job. More than one print job can be in the course of printing at any one time. By way of example, a single print job may use one or more printers of a first modality (such as black only) and/or one or more printers of a second modality (such as process color or custom color). Print media may be printed using two or more printers of different modalities or by two or more printers of the same modality. The marking devices 22A, 22B, 22C, and 22D all communicate with the network print server 12. It will be appreciated that the printing system 10 may include fewer or more printers, depending on the anticipated print volume.

Figure 3:
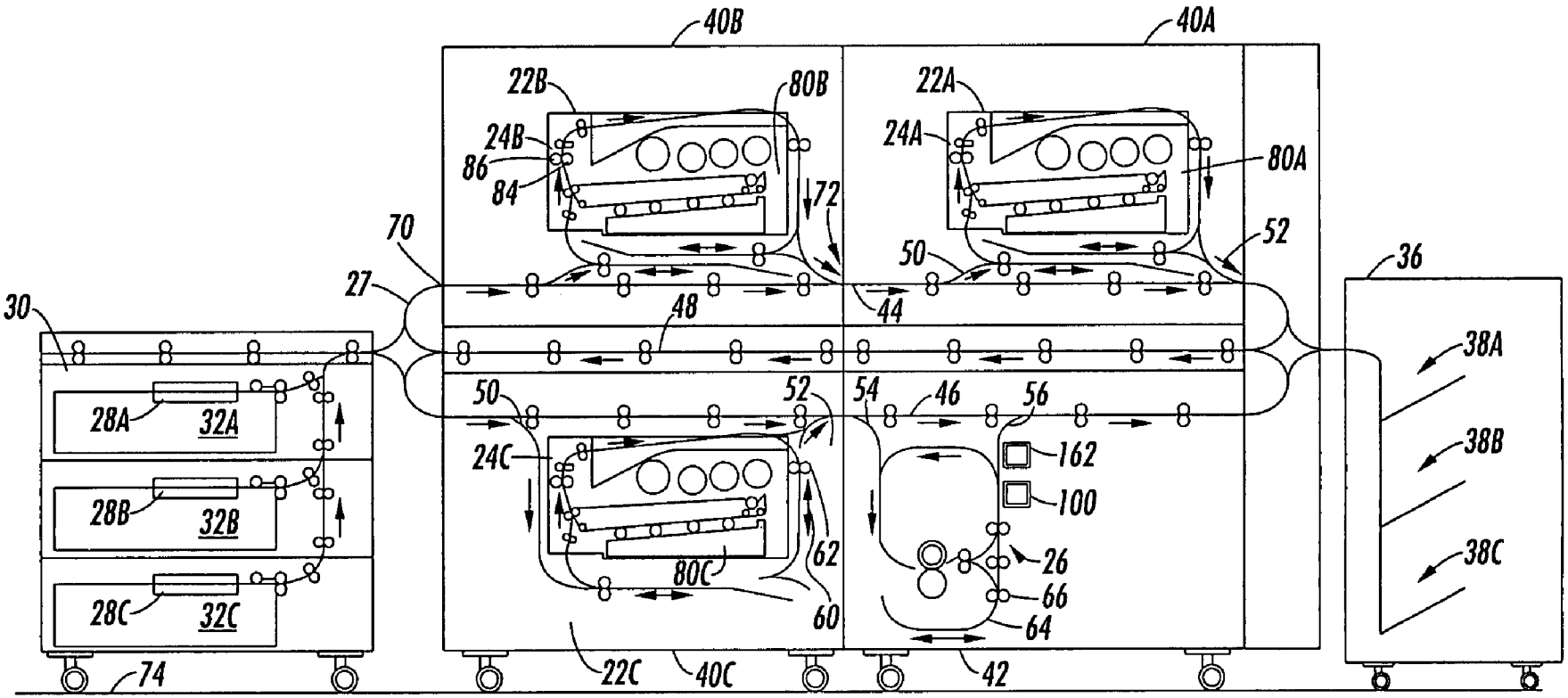
FIG. 3 is a schematic side sectional view of an alternative embodiment of a printing assembly for the printing system of FIG. 1.

With reference also to FIG. 3, which shows a similar printing assembly to that shown in FIG. 2, except that three printers 22A, 22B, 22C are illustrated, although fewer or more printers may be used. The printers may be fed with print media 28 from a single high speed and capacity feeder module (F) 30 including a plurality of print media sources 32A, 32B, 32C, although it will be appreciated that one or more of the printers may be fed from one or more separate feeders. The print media sources 32A, 32B, 32C may be loaded with print media 28A, 28B, 280 of different types. For example, source 32A supplies paper sheets of one surface finish or weight, while another 32B supplies paper sheets of a different surface finish or weight. The surface finishes may be selected to allow the printed sheets to achieve different selected levels of gloss. For example, the sheets in one of the sources may be treated with a coating or calendered, which allows a high level of gloss. The different surface finishes may benefit from different fusing treatments to permanently affix an image to the media and/or achieve a selected level of gloss.

As illustrated in FIG. 3, the media handling system 27 is configured for transporting printed media from each of the printers 22A, 22B, 22C, to the secondary fusing device 26, while allowing selected ones of the printed media to bypass the secondary fusing device. A finisher module 36 with one or more separate finishing capabilities, here represented by output trays 38A, 38B, 38C, receives printed media from the secondary fusing device 26 and/or any one of the clustered printers 22A, 22B, 22C.

One or more of the printers 22A, 22B, 22C, feeder module 30, and finisher module 36 are in the form of interchangeable and/or replaceable modules. For example, each of the printers is housed in a separate module 40A, 40B, 40C, which carries a portion of the media handling system 27 of flexible pathways. The lower modules are carried on wheels. Similarly, the secondary fusing device is housed in its own module 42, which also caries a portion of the media handling system 27 and is linked with the finisher module 36. Other arrangements for connecting the respective printers with the secondary fusing device and finisher module are also contemplated.

The media handling system 27 includes two downstream print media highways 44, 46, which extend from the feeder module 30 to the finisher module 36, and one or more upstream highways 48, which travel in a generally opposite direction to the downstream highway, allowing print media to travel between a downstream and an upstream device. Pathways 50, 52 feed the print media between the media highways 44, 46 and selected ones of the printers. Pathways 54 and 56 feed the printed media to and from the secondary fusing device 26. It will be appreciated that one or more additional highways may be provided to allow printed media to travel between downstream and upstream printers.

The highways 44, 46 and/or pathways 50, 52, 54, and 56 may include inverters, reverters, interposers, bypass pathways, and the like as known in the art to direct the print substrate between the highway and a selected printer or between two printers. It will be appreciated that the printers may be configured for duplex or simplex printing and that a single sheet of paper may be marked by two or more of the printers or marked a plurality of times by the same printer, before reaching the secondary fuser 26. For example, inversion pathways 60, each including an inverter 62, allow a print substrate which has already been printed on one side to be inverted prior to printing on the other side by the same or by a different printer. The secondary fusing device 26 can also function as a simplex or duplex device. In one embodiment, an inversion pathway 64 includes an inverter 66 which allows printed media to be inverted after passing through the secondary fusing device 26.

Each printer module 40 supports a portion of a downstream print media highway 44, 46 with an input 70 and an output 72, which may be arranged at the same height above a support surface 74, as the input and output of one or more adjacent modules for ease of interconnection of the print highway. Alternatively, the modules may be horizontally stacked or otherwise oriented.

Although each of the marking devices 22 is shown linked to the secondary fusing device 26 by the same highway 46, either directly, or indirectly via return highway 48, it is to be appreciated that the printers may alternatively be linked by separate pathways to the common secondary fusing device 26.

Each printer 22 includes an image forming component 80A, 80B, 80C, capable of forming an image on the print media, and at least one primary fusing device 24, which may be integral to the image forming component, or separate therefrom. The image forming component 80 typically includes a charge retentive surface, such as a photoconductor belt or drum, a charging station for each of the colors to be applied, an image input device which forms a latent image on the photoreceptor, and a toner developing station associated with each charging station for developing the latent image formed on the surface of the photoreceptor by applying a toner to obtain a toner image. A pretransfer charging unit charges the developed latent image. A transferring unit transfers the toner image thus formed to the surface of a print media substrate, such as a sheet of paper.

The primary fusing device 24 may be of the type conventionally used with xerographic printers. For example, as illustrated in FIG. 3, the primary fusing device 24 may include a heat applying component 84, such as a heated roller and/or a pressure applying component 86, such as a roller or pair of rollers. The heat applying component and pressure applying component may be adjacent, to define a nip therebetween, as shown, or be spaced along the paper pathway. The heated roller is brought into contact with the imaged media to at least partially melt the toner forming the image. The pressure applying roller or rollers apply pressure to the partially melted image. Other primary fusing devices 24 are also contemplated to melt the toner and fuse it with the fibers of the paper or other media. These include non-contacting radiant fusing devices, fusing systems which use intense electromagnetic radiation in the visible or UV portion of the electromagnetic spectrum, such as from a quartz rod, light emitting diodes or laser diodes (both of which will be referred to herein as LEDS). The secondary fusing device 26 may be similarly configured to the primary fusing device, or different, as described below.

The primary fusing device 24, in this embodiment, serves as a blanket fuser, in that it applies a fusing treatment to the entire image formed in the respective image forming component.

The primary fusing device 24 performs at least a partial fusing of the image applied by the image forming component 80. By partial fusing, it is meant that the fixing of the image is not up to the desired level for the final printed media and/or the appearance of the image, e.g., gloss level, is not within desired tolerances, over at least a portion of the image. For example, the primary fusing device serves to at least tack the toner image to the print media (i.e., a partial fixing) in such a way as to allow the print media and toner image to be transported to the secondary fusing device 26, which completes the fusing of the image, for example by modification of the gloss and/or further fixing. In this embodiment, both primary and secondary fusing devices contribute to the fusing of the image on at least a portion of the sheets of print media. The primary fusing device may thus serve to provide what will be referred to as "in situ permanence," while the secondary fusing device is used to generate a desired level of archival permanence and final image appearance. In this embodiment, both primary and secondary fusing devices contribute to the fixation of the image and/or the image quality of at least a portion of the sheets, and/or portions of individual sheets.

To minimize the demands on the integral fusing devices 24, in one embodiment, only enough heat (in the case of a fusing device incorporating heat) or other fusing parameter, such as pressure, light, or other electromagnetic radiation, is used to provide in situ permanence. The gloss level of the imaged media exiting the printer 22A, 22B, 22C, etc. and arriving at the secondary fusing device 26 can thus be lower than that desired for its final appearance. Additionally, the level of fixing can be lower than that desired for archival permanence. As a result, reliability and lifetime of the individual printers is improved. Paper handling can also benefit from the use of a secondary fusing device to provide at least a portion of the permanence and/or final appearance of the flexible media. Specifically, heat, and other forms of fusing tend to influence paper shrinkage, curl, and similar properties which affect sheet registration. By minimizing the heat or other fusing parameter used in each marking device 22, these paper handling effects can be mitigated.

Another advantage of the dual fuser system is that higher throughputs can be achieved by reducing the constraints the integral fusing devices 24 place on the printers 22. In a conventional printing system, the throughput of the fusing device often limits the throughput of the printer 22 and thus of the overall printing assembly 16. The dual fusing system allows higher throughputs for each of the printers and thus a higher total productivity to be achieved. There are several ways in which the use of the secondary fuser improves throughput including parallelism and separation of fixing and final appearance functions, which can be used alone or in combination. Parallelism may include the provision of a plurality of secondary fusing modules, each providing the secondary fusing function for a portion of the printed media output. For example, printed media can be selectively directed from the media highway 44 to one of a plurality of fusing devices 26. The printing system may also take advantage of a scheduling function in the print server. Thus, for example, final finishing of sheets requiring a higher level of gloss may be scheduled to take place at the same time, once the secondary fusing device 26 has reached the operating conditions, such as temperature, for achieving the higher gloss level. Separation of fixing and final appearance functions allows the final appearance to be controlled by a separate device from that of the permanence function. Multi-pass fusing, in which sheets are routed through the secondary fusing device 26 multiple times, may also be employed in order to achieve a targeted level of permanence and/or appearance.

In one embodiment, the secondary fusing device 26 applies a fusing treatment, or a different fusing treatment, to a selected portion or portions of a printed sheet, the portion or portions encompassing less than the entire area of the image. For example, portions of the image, such as text, may be left matte, while other portions, such as those incorporating artwork, may have the level of gloss raised.

The secondary fusing device 26 may be called upon only in cases where there is a fusing shortfall (fixing, image gloss, image gloss uniformity, productivity) of the primary fusing devices. In this embodiment, the secondary fusing device 26 does not treat all the printed media. For example, the primary fusing devices may have sufficient fusing capability such that full fusing of the images on a particular type of paper, at a selected gloss level and desired level of fixing, and at a given productivity, is achieved without operation of the secondary fusing device. Thus, at some times during printing, the primary fusing devices 24 may have the ability to complete the fusing of the printed images (in terms of both fixing and desired appearance characteristics), without the need for the secondary fusing device 24. In such cases, the secondary fusing device 26 is optionally bypassed and the printed media is directed from the printer(s) 22 directly to the finishing module 36. At other times, for example, in order to maintain full productivity and/or when the print media substrate to be used or gloss level desired is such that the primary fusing device cannot maintain complete fusing, the primary fusing device of one or more of the printers 22 effects a partial fusing, e.g., it at least serves to tack the toner image to the print media in such a fashion as to avoid image disturbance as the sheet is transported by the media handling system 44 to the secondary fusing device 26, where the fusing process is completed. The secondary fusing device 26 can be designed such that it has fusing latitude to accomplish the specified final image fixing and appearance of the media.

In another embodiment, all of the printed media is directed through the secondary fusing device 26. In this embodiment, the secondary fusing device may apply a fusing treatment to all the media, to only to selected sheets of the media, and/or to selected portions of sheets of the media.

The secondary fusing device 26 allows a high gloss mode to be specified. In this mode, a gloss level higher than that which can be achieved by an individual marking engine at the desired productivity for the particular print media selected is achieved.

With reference once more to FIG. 1, a control system 90 controls the secondary fusing device 26. The control system 90 includes a driver 92 and an algorithm 94, such as a look up table, which is input with information that the control system uses in determining whether to employ the secondary fusing system and/or what amount of secondary fusing to apply (e.g., in terms of amount of heat and/or pressure). For example, the algorithm may be input, prior to printing, with characteristics of each of the printers, such as:

1. The gloss level which is achieved at a given processing speed, and for a selected print media;
2. The extent to which the printer provides adequate fixing of the selected print media at the given processing speed;
3. The extent to which the printer exhibits non uniformity across the sheet (i.e., perpendicular to the direction of media flow), e.g., a gloss level which varies across the sheet;
4. The extent to which one printer compensates for inadequacies of a prior printer (where more than one printer is used for imaging a single sheet); an
5. The extent to which different toners and/or paper properties, such as weight, surface finish, and surface roughness of the print media affect the fixing or appearance.
6. The extent to which toner pile height affects fusing. Certain colors, such as brown, are made up of several layers of different toner colors, and thus areas of the image where these colors are found have a greater pile height than others where the colors are formed with fewer toner layers. The higher pile heights tend to achieve a glossier image than the lower pile heights. Thus, an image with areas of different colors may have areas of different gloss, creating an undesirable overall image.

The control system addresses the secondary fusing device to correct unwanted variations in fusing characteristics both across the sheet and between sheets from different printers. The control system 90 is also linked to the printer server 12, which provides the control system with advance information, such as which of the media 28A, 28B, 28C is being selected, the routing of the selected media to the various printers 22, and information for determining the time of arrival of the printed media at the secondary fusing device 26. It will be appreciated that all or a portion of the functions of the control system 90 may be incorporated in the print server 12 itself. The control system determines the appropriate level of secondary fusing to apply to the media to achieve preselected final fusing characteristics (appearance and/or level of fixing) and the driver 92 controls the secondary fusing device so as to achieve these characteristics.

In one embodiment, the secondary fusing device 26 is addressable in that it enables X,Y coordinates (pixels) of the print media to be individually and selectively treated, for example, with different amounts of fusing energy (typically heat). The pixels are generally larger in area than the smallest discrete points of the image.

For example, if one printer is known to have a defect which causes the gloss level to be slightly lower on one side of the printed media than on the other, the control system 90 instructs the secondary fusing device compensate for the defect, for example, by applying more heat to the low gloss side of the media.

In the event that the desired final appearance and fixing characteristics fall outside the ranges for these characteristics which the secondary fusing device 26 is capable of providing for the selected media, the control system 90 may instruct the print server 12 to vary operation of the printing system 16 so that the desired final appearance and fixing characteristics can be achieved. For example, by slowing the processing speed of one or more of the printers 22, using a different printer, or printers, or adjusting the level of blanket fusing (e.g., increasing one or more of heat, pressure and dwell time) provided by the primary fusing devices 24, the primary fusing devices 24 achieve a higher level of fusing.

In one embodiment, the control system receives information regarding the spatial locations of the digital images used to form the image (four in the case of a CMYK printer) and determines the pile heights of toner resulting from overlapping of these images. The algorithm is input with information regarding the relationship between the pile height and the gloss level associated therewith for a particular printer. The control system determines a further fusing treatment for those portions of the image of lower pile height such that the differences between gloss levels of different areas of the image are reduced. The control system addresses the secondary fusing device 26 which selectively adjusts the gloss level of portions of the image, for example by applying more heat or pressure to the lower gloss areas, such that the overall image is of an even gloss, or the undesired differences in gloss are minimized.

In one embodiment, the secondary fusing device is used to apply the equivalent of a watermark to the print media by providing an area of the print media imaged surface, which is of a different, e.g., a higher gloss level. The area may be of a preselected shape, e.g., the shape of a company logo. The area of different gloss is distinguishable to the eye, for example, when the print media is tilted at a sufficient angle. Information on the shape and location of the gloss watermark may be stored in the control system algorithm. Where the gloss watermark comprises an area of higher gloss than the surrounding area, the control system addresses the secondary fusing device to selectively apply heat to the area of the print media where the gloss watermark is to be formed.

Where there is more than one secondary fusing device 26, the control system 90 may select an appropriate secondary fusing device 26 for achieving the desired final appearance. Alternatively, the sheet may be passed through a secondary fusing device multiple times, and/or the secondary fusing device may be adjusted to achieve the desired final appearance and/or permanence.

A scheduling system (not shown), which may be incorporated in the network server 12, takes into account the different speeds of the printers, the finishing requirements, and the like in scheduling the print jobs, as described, for example, in U.S. application Ser. No. 10/284,560, filed Oct. 30, 2002, Ser. No. 10/688,961, filed Oct. 21, 2003 and Ser. No. 10/284,514, filed Oct. 30, 2002, all by Fromherz, which are incorporated herein by reference in their entireties. The scheduling system may also determine a route for each sheet of each of the print jobs through the printing assembly so that by the time the sheets arrive at the secondary fusing device 26, the secondary fusing device is in an operational mode (e.g., ready to heat the media).

In the event that a fault occurs in a primary fusing device 24 of one of the printers 22, such that the primary fusing device is performing a lower level of fusing than anticipated, but still enough to tack the image to the media, the control system 90 or print server 12 recognizes that the fusing is incomplete and, if appropriate and can be compensated by the secondary fusing device, instructs the secondary fusing device to compensate for the defect.

A sensor 100 detects a fusing characteristic of the printed media. In one embodiment, the sensor 100 includes an appearance sensor which senses an appearance characteristic of the printed media, such as a gloss meter which measures gloss. Gloss can be determined in a number of ways, for example, specular gloss is the percentage of the intensity of the incident light (at a specified angle of incidence, e.g., at 20, 60, or 85 degrees, and in a specified wavelength range) which is reflected from the surface. The appearance sensor 100 may alternatively or additionally include means for measuring other optical appearance properties, such as a calorimeter, spectrophotometer and/or other means for generating and processing color information.

The appearance sensor 100 may be positioned to detect the appearance characteristic of media after all fusing treatments have been applied. Alternatively or additionally, the sensor may be positioned to detect the appearance characteristic after the primary fusing step but prior to secondary fusing step. In FIG. 3, the appearance sensor 100 is positioned adjacent paper path 56 to evaluate the appearance of media after the media has been treated by the secondary fusing device 26. The appearance sensor may evaluate the appearance characteristic(s) of all printed media or only a portion thereof. For example, the sensor may be positioned in a side path 102, as illustrated in FIG. 2. A portion of the printed media is directed from the main highway 44 into the side path 102 while the appearance measurements are made. In this way, the sensor 100 has time to undertake a plurality of measurements without impacting the overall processing speed of the printing system. Once the measurements are complete, the printed media is returned to the main path.

In another embodiment, the sensor measures a property which is related indirectly to the appearance characteristic. For example, the sensor may detect a surface property of the fuser roll of the primary fuser, such as smoothness or gloss, which can be related, for example by use of a look up table, to the gloss of the printed media.

The sensor 100 is linked to the control system 90, which stores information from the sensor in the algorithm 94. Measurements on gloss and/or other fusing characteristics are thus used by the control system to determine appropriate settings for the secondary fusing device 26.

In one embodiment, the sensor 100 is used to precalibrate the control system 90. Periodically, e.g., daily, or after each print run, test sheets are printed by the various printers and fused. The appearance characteristics are then compared with a set of stored desired appearance characteristics and adjustments to the control algorithm 94 for the secondary fusing device 26 and/or primary fusing devices 24 are made. The stored characteristics may be generated by directing printed media which has been predetermined to meet appearance characteristics to the sensor 100.

In another embodiment, the appearance sensor 100 is used to ensure that print characteristics of a print run are being met. Printed media whose appearance is determined to be outside selected appearance tolerances is discarded. Based on the variation of the gloss level from the final appearance characteristics desired, the controller accesses the algorithm to determine the appropriate final appearance treatment which is to be applied by the secondary fusing device 26 for subsequent media to bring the appearance characteristics within acceptable tolerances. In this way, adjustments can be made during a print run or at other appropriate times.

In one aspect, the system enables differences between the fusing characteristics of printed media from two or more printers 22 which each print portions of a print job to be reduced. Specifically, the control system 90 evaluates differences in the print characteristics from the two or more printers and addresses the secondary fusing device 26 to correct for those differences. For example, where the control system determines that one printer is achieving a higher level of gloss in the outputted printed media than another printer, the control system instructs the secondary fusing device to raise the gloss level in the printed media from the printer which is providing the lower gloss. In this way, the pages of a document are more similar in their appearance to the eye.

Figure 4:
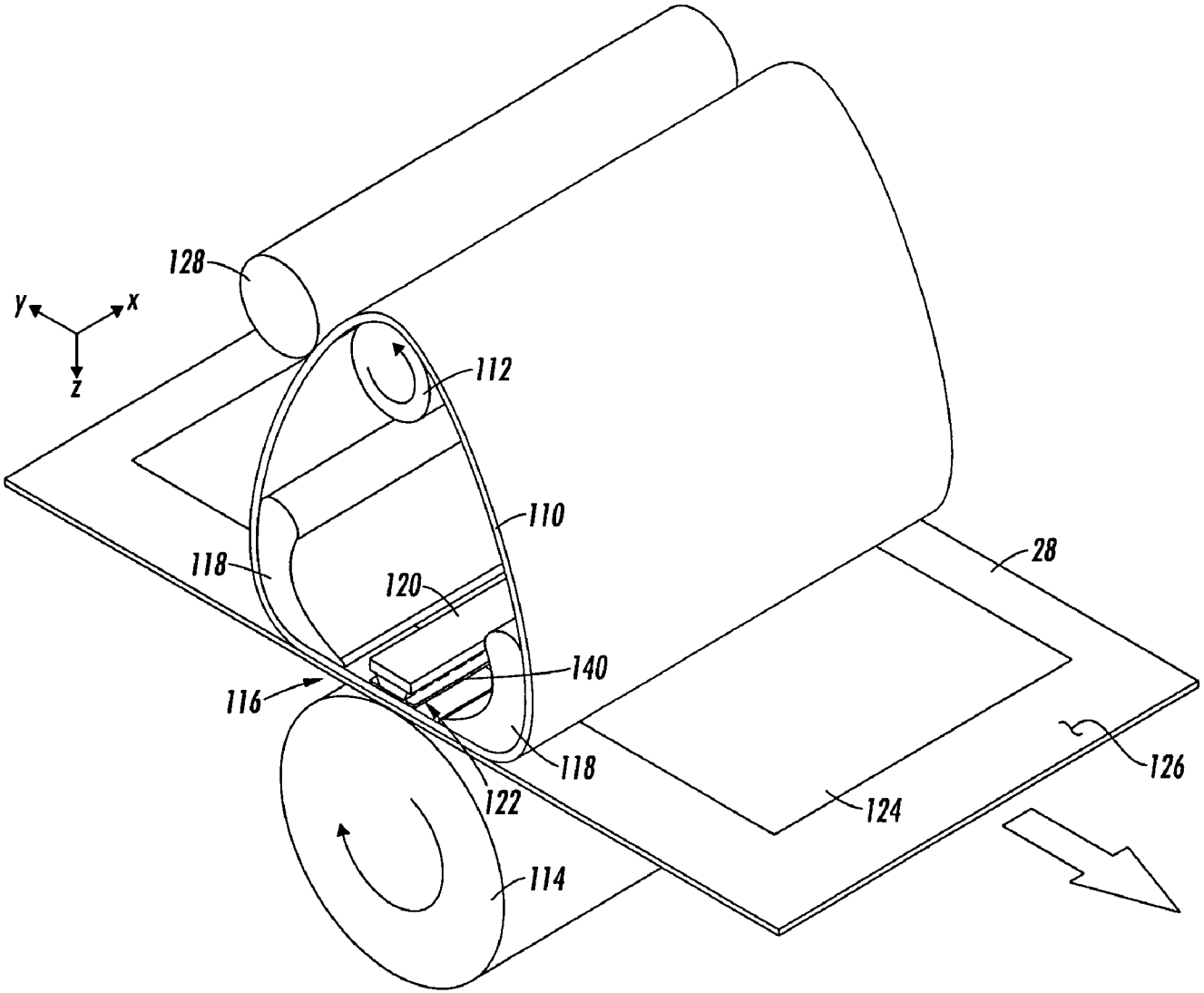
FIG. 4 is an enlarged perspective view of a first embodiment of the secondary fusing device of FIGS. 2 and 3.
Figure 5:
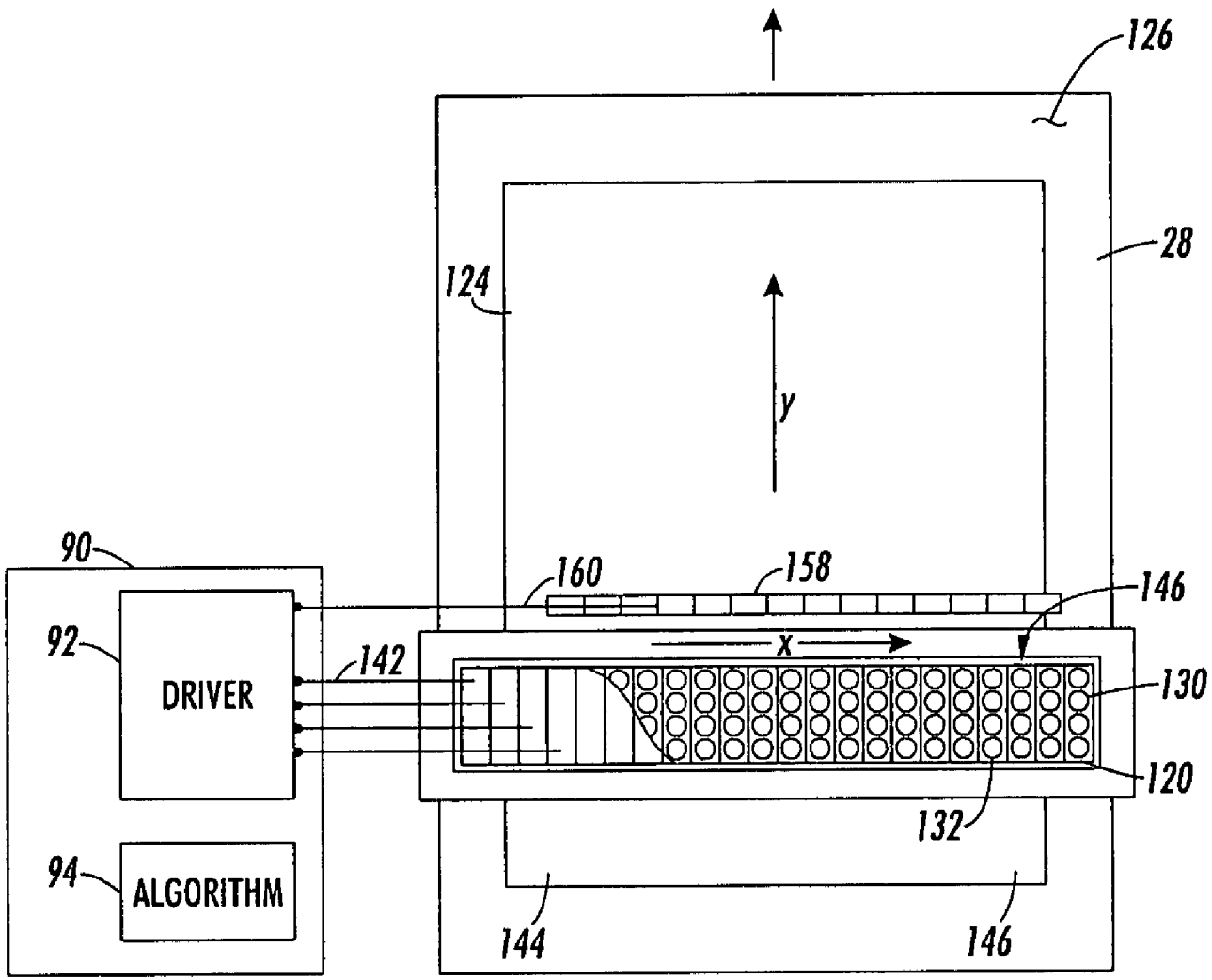
FIG. 5 is top plan view of the secondary fusing device of FIG. 4, in partial section.

With reference now to FIGS. 4 and 5, one embodiment of an addressable fusing device 26 is shown. The fusing device 26 includes a first contacting member 110, in the form of a continuous flexible belt, which is rotated by a drive roll 112. A second contacting member 114, in the form of a driven pressure roll, is located on the other side of the paper path from the belt to define a nip 116 therebetween. The pressure roll 114 is rotated about an axis parallel to that of the drive roll 112, and perpendicular to the direction of travel of a sheet 28. The belt 110 is held in pressure contact with the pressure roll 114 by an arcuate guide member or members 118, located interior of the belt. A source 120 of electromagnetic radiation is located interior of the belt, parallel or generally parallel with the axes of the drive roll and pressure roll. The source 120 directs radiation towards the belt through a slot 122 in the arcuate member 118. The electromagnetic radiation source 120 is capable of fusing an image 124 on an adjacent surface 126 of a sheet of printed media 28 passing through the nip 116 in the direction shown. While FIG. 4 shows the source 120 as being located directly above the nip 116, the source may be located slightly to the inlet side of the nip such that the belt and/or image is heated or otherwise affected by the radiation prior to entering the nip. Additionally, while both the first and second contacting members 110, 114, are can be separately driven, one of the contacting members may serve to drive the other. A cleaning and/or tensioning roller 128 removes excess material from the belt, such as unfused or incompletely fused toner particles.

In one embodiment, the belt 110 is transmissive to the radiation provided by the source 120. In another embodiment, the belt 110 absorbs all or a portion of the radiation and is locally heated thereby. The composition of the belt is therefore dependent, in part, on the type of radiation used. In one embodiment, the flexible belt 110 has a high thermal conductivity through the belt (in the z direction) and a low lateral thermal conductivity (in the y and/or x direction) to facilitate the transfer of heat or other radiation from the source 120 to the upper surface 126 of the print media. The heat capacity and heat transfer properties of the belt 110 are optionally matched to the processing speed of the print media 28.

While the first contacting member 110 is described in terms of a flexible continuous belt, it is also contemplated that the first contacting member 110 may be rigid, such as a hollow cylinder formed, for example, from fused quartz, such as Pyrex™, or other material capable of transmitting the radiation therethrough and/or absorbing radiation to produce localized heating of the cylinder. Optionally, a disposable member, such as a noncontinuous belt (not shown) is located intermediate the hollow cylinder/continuous belt 110 and the pressure roller 114 which prevents any residual material, such as unfused toner, from accumulating on the outer surface of the first contacting member 110. The noncontinuous belt may be stored on a source roll, on an input side of the nip and taken up by a take-up roll on an output side of the nip. Such a disposable fuser belt may be formed, for example, a thin sheet of IR-transparent, thermally insulating material, such as MYLAR™, available from DuPont Corp., Delaware.

The radiation provided by the source 120 may be any portion of the electromagnetic spectrum capable of affecting fusing of the image, either directly or indirectly (e.g., through heating of the belt), such as infrared radiation, visible light, and/or UV radiation. The particular choice of radiation may depend, to some degree, on the composition of the image, such as the toner composition. Infrared radiation may be used to effect localized heating of the belt or image. Light in the visible range may also be used, for example, to the extent that either the belt or image absorbs the light and converts it to heat. Radiation from two or more wavelength ranges, e.g., both visible and IR ranges, may be used.

With continuing reference to FIG. 5, which shows a top plan view of the fusing device 26 of FIG. 4, partially cut away for clarity, the electromagnetic source 120 includes an array 130 of addressable electromagnetic sources such as an N×M array 130 of individual radiation generating elements 132, wherein $N \geqq 1$ and $M \geqq 1$, N representing a number of elements in the y direction (direction of flow) and M representing a number of elements in the x direction, (perpendicular to the direction of flow). In one embodiment, N is at least 1, such as at least 2, 4, 8 or 10 and M is at least 10, such as at least 20, 50, or 100. For example M can be equivalent to at least about three elements 132 per cm, e.g., 4/cm. Each element 132 is independently addressable so that each may be turned on/off independently of the other elements. Compared with the number of pixels in an image, the array thus provides a relatively coarse distribution of radiation generation elements. While the elements 132 in each y direction row are shown aligned with each other, in the direction of flow, it is also contemplated that the elements may be staggered, thereby increasing the addressable resolution by increasing the number of independently addressable regions in the x direction of the array.

In the illustrated embodiment, the radiation generating elements 132 each include one or more LEDs, such as light emitting or laser diode such as a vertical-cavity surface-emitting laser (VCSEL). Depending on the wavelength desired, the elements 132 may generate infrared, visible, or UV radiation. The elements 132 are in thermal or optical communication with the nip 116 through the slot and a portion of the belt 110 that is immediately adjacent the nip 116 at a given time during the belt's rotation. As an alternative, the individually addressable elements 132 may be provided by rastering a single source analogous to the ROS exposure of a photoreceptor.

Optionally, a lens or a lens array 140 (FIG. 4) is located intermediate the source 120 and the belt 110 for focusing the radiation from the source. At least one of the source 120 and the lens or lens array 140 may be selectively positionable, in the z direction to change the focusing. A positioning mechanism (not shown) may be under the control of the control system 90.

With continued reference to FIG. 5, the elements 132 of the array 130 are coupled to the driver 92 by suitable electrical connections 142, such that each element is independently addressable by the driver. In this way, portions of the image can be separately subjected to a fusing treatment. For example, for x direction corrections, e.g., where the control system 90 determines that only the left side 144 of the image 124 meets acceptable gloss levels, selective or higher irradiation of the right side 146 of the image is used to increase the gloss on that side, and provide a more even gloss appearance. For y direction corrections, the control system driver may activate or deactivate elements 132 part way through fusing of the sheet.

The amount of heat, or other form of radiation, supplied to the image, can be controlled by switching selected ones of the elements 132 on or off. For example, when N is four, as illustrated in FIG. 5, the greatest level of heating of the portion of the image which receives heat from a row 146 of four elements may be achieved when all of the four elements 132 in any row are on. When lower levels of heating are required, one or more of the elements is switched off. Alternatively or additionally, the intensity of the radiation output of the elements 132 is variable and the level of heating can be adjusted by varying the power supplied to the element(s). It will be appreciated that there may be a time lag between applying power to the elements 132 and the supply of heat to the image, which is taken into consideration by the control system 90.

Optionally, a temperature sensor 158, located adjacent the nip, provides feedback control information to the control system 90. The temperature sensor 158 may include an array 160 of temperature sensing elements whereby the approximate temperature and or variation of the elements 132 and/or fused image 124 in the x direction is determined. Based on a temperature signal or signals from the temperature sensor 158, the control system 90 directs the driver 92 to activate the addressable heating elements 132 to provide a select amount heat or other form of radiation to achieve the desired level of fusing.

The control system receives registration information regarding the positioning of the image 124 on the sheet 28 from the print server 12, e.g., (X, Y, θ) coordinates of the image, where θ represents the degree of skew. In one embodiment an electronic image corresponding to the image to be created is stored in rasterized format such as is created using a raster output scanner (ROS). In another example embodiment, electronic image is stored as a bitmap. In yet another embodiment, direct information on the actual location of the image is provided, for example, by recording a digital image of the formed image on the printed media, e.g., with a scanner. The electronic image coordinates and/or actual image coordinates are provided to the control system 90. This ensures that the heat image on the print media 28 is the same size or only marginally larger than that defined by the image 124. In this way heat is only applied where it is needed, and as needed. This reduces power consumption and extends the life of the secondary fusing device. Of course, where only a portion of the image 124 is to be subjected to the secondary fusing treatment, the heat image can be smaller than the image. In one embodiment, the toner image includes cyan, yellow, magenta and black images, and the addressable elements 132 are activated so that an area that is at most only minimally larger than that defined by the union of these images is heated.

The controller may also receive information on the color of toner applied to each separately addressable region of an image, since the toner color may affect the gloss. Where more than one color is present in an addressable region, the controller may perform a weighting or averaging of the colors present, based on the proportions of each color and the effect each color has on gloss.

As the printed media 28 proceeds through the nip 116 of the secondary fusing system, elements 132 in array 130 are selectively activated by driver 92 based on the information stored in the control system 90, such as the extent of additional fusing required, the areas of the image where additional fusing is required, and the location of the image 124, so that substantially only those portions of the surface 126 to be treated are heated or otherwise subjected to electromagnetic radiation.

Since the level of gloss generally increases with the heat applied, it is generally desirable for the level of gloss achieved in the primary fusing device to be below or within the targeted gloss range. However, under some circumstances, downward modification of gloss can be achieved, for example by supplying sufficient heat that the surface of the image is essentially damaged, or by using an uneven pressure roller, rendering the surface of the image slightly uneven and thus lower in gloss.

In one embodiment, the secondary fusing device 26 further includes a preheater (not shown) which uniformly heats the print media (or the imaged portion) prior to addressable fusing.

To remove unwanted toner or other image forming material, from the printed media which has not been fused, a cleaner 162 (FIG. 3) is located in the print media transporting system downstream of the secondary fusing device. The cleaner can be an electrostatic cleaner, similar to that commonly used to clean a photoreceptor belt.

Where the printed media is printed on both sides with an image, both sides can be treated by the secondary fusing device 26, for example by inverting the sheet and repassing the sheet through the secondary fusing device, or by having two secondary fusing devices arranged in series, one for the first side of the sheet, the other for the second side. In another embodiment, both sides of the sheet are simultaneously treated by the secondary fusing device 26. A fusing system adapted for two sided secondary fusing of printed media is illustrated in FIG. 6, where similar elements are given the same numbers and new elements are given new numerals.

Figure 6:
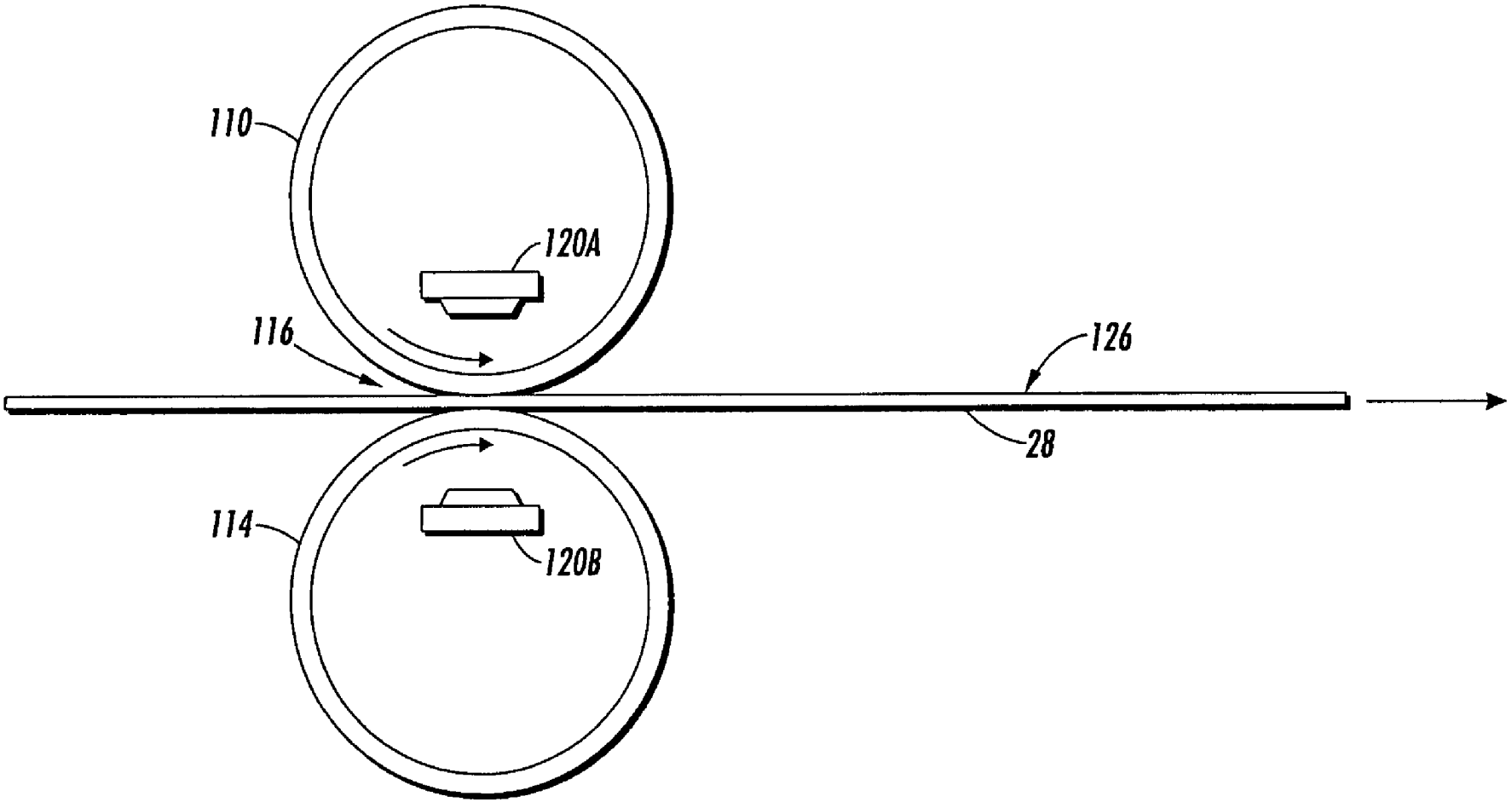
FIG. 6 is an enlarged perspective view of a second embodiment of the secondary fusing device of FIGS. 2 and 3.

In the embodiment of FIG. 6, the first and second contacting members 110, 114 of the two-sided fusing device 26 are each in the form of a driven hollow cylinder with a source of electromagnetic radiation 120A, 120B positioned therein to direct radiation towards the printed media 28 from opposite sides of the nip 116. The operation of the secondary fusing device of FIG. 6 is essentially the same as described above in connection with that of FIGS. 4 and 5, except in that the control system selectively addresses the elements 132 of both radiation sources 120.

Figure 7:
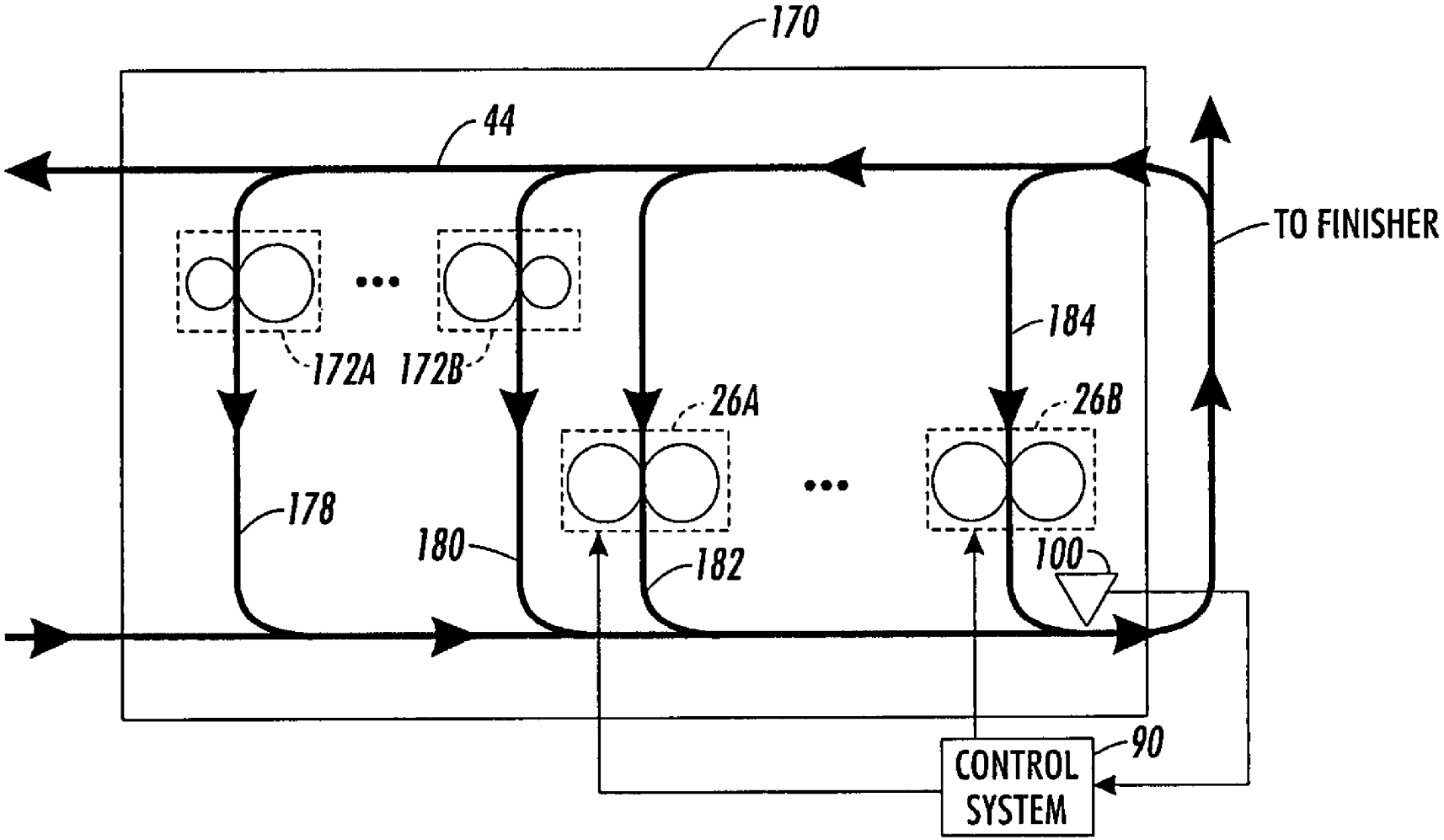
FIG. 7 is a schematic view of a secondary fusing assembly incorporating the secondary fusing device of any one of FIGS. 4-6.

With reference now to FIG. 7, a modular fusing system 170 is shown, where similar elements are given the same numerals and new elements are accorded new numerals. The modular fusing system 170 includes one or more addressable secondary fusing devices 26A, 26B (two in the illustrated embodiment) and one or more parallel fixing modules 172A, 172B (two in the illustrated embodiment). The modules 26A, 26B, 172A, 172B are linked to the main highway 44 by paper pathways 178, 180, 182, 184, such that printed media may be directed to any one of the modules, or sequentially, to more than one of the modules. Each of the secondary fusing devices 26A, 26B may be similarly configured to the addressable fusing device 25 of FIGS. 4 and 5 or FIG. 6 and are under the control of a control system 90. The modules 172A, 172B may be used for gross modification of the fusing (gloss and/or fixing) which benefits from treatment of the entire image. The modules 172A, 172B need not be addressable and can be configured similar to conventional fusers. The secondary addressable fusing devices 26A, 26B can be used for final appearance correction, e.g., minor localized modifications to all or portions of the image. A sheet may thus pass first through a fixing module 172A, 172B for gross modification of the fusing characteristics (fixing and/or gloss), followed by a final treatment in one of the final appearance modules 26A, 26B. In this way, the final appearance modules 26A, 26B, can function in a narrow tolerance range, and with greater accuracy. As with the embodiment of FIGS. 2 and 3, the image, before reaching anyone of the modules 172A, 172B, 26A, 26B, has already been subjected to one or more of the primary fixing devices 24 in the individual printers 26.

While the embodiments have been described as including primary and secondary fusing devices in which the secondary fusing device includes an addressable array of fusing elements, it will be appreciated that one or more of the primary fusing devices may alternatively or additionally include an addressable array of fusing elements similar to that described for the secondary fusing device 26. Where the addressable array is in the primary fusing device(s) it serves to at least tack the image to the print media. For the primary fusing device, addressable fusing enables a heat image only marginally greater than the printed image to be applied, thereby reducing power consumption and extending the lifetime of the primary fusing device. The secondary fusing device, in this embodiment, may apply a blanket fusing treatment to the print media The claims, as originally presented and as they may be amended, encompass variations, alternatives, modifications, improvements, equivalents, and substantial equivalents of the embodiments and teachings disclosed herein, including those that are presently unforeseen or unappreciated, and that, for example, may arise from applicants/patentees and others.

The invention claimed is:

1. A printing system comprising:

at least one marking device for applying toner images to print media, each of the marking devices including a primary fusing device for applying a primary fusing treatment to the applied toner images exiting the at least one marking device to at least tack the toner images to the print media and at least partially fuse a toner forming the toner images;

a secondary fusing device which receives printed media from the at least one marking device and selectively applies a further fusing treatment to further fuse the toner forming the applied toner images thereon, the secondary fusing device including an array of selectively independently addressable energy generating elements;

a media handling system which transports printed media to which the first fusing treatment has been applied along a paper path from the each of the marking devices to the secondary fusing device; and a control system operably coupled with the secondary fusing device, the control system including a driver which selectively actuates the addressable energy generating elements to correct unwanted variations in fusing characteristics, whereby a selected portion of the toner of an applied image receives a further fusing treatment which is different from a further fusing treatment received by a second portion of the toner forming the applied image such that a difference between a gloss level of a first portion of the applied image and a gloss level of a second portion of the applied image is reduced.

2. The printing system of claim 1, wherein the at least one marking device includes first and second marking devices, the secondary fusing device receiving printed media from the first and second marking devices.

3. A printing system comprising:

at least one marking device for applying images to print media;

a primary fusing device associated with each of the marking devices for applying a primary fusing treatment to the applied images exiting the at least one marking device, the first fusing treatment serving to at least tack the applied toner images to the print media without ensuring that a desired fusing characteristic is achieved;

a secondary fusing device which receives printed media from the at least one marking device without intermediate application of toner and applies a further fusing treatment to the applied images thereon, the secondary fusing device including an array of selectively addressable energy generating elements;

a control system operably coupled with the secondary fusing device, the control system including a driver which selectively actuates the addressable energy generating elements, whereby portions of the image can be separately subjected to a fusing treatment;

the control system evaluating whether the primary fusing treatment has achieved a desired fusing characteristic and, where the primary fusing treatment has not achieved the desired fusing characteristic, selecting a further fusing treatment to be performed by the secondary fusing device appropriate for achieving the desired fusing characteristic by selective actuation of the addressable energy generating elements to apply more heat to a lower gloss area.

4. The printing system of claim 1, wherein the secondary fusing device is adapted for applying at least one of heat and pressure to the image.

5. The printing system of claim 1, wherein the further fusing treatment modifies a fusing characteristic of the printed media, the fusing characteristic comprising at least one of degree of fixing and level of gloss.

6. The printing system of claim 1, wherein the array of energy generating elements comprises an array of radiation generating elements.

7. The printing system of claim 6, wherein the radiation generating elements generate radiation in one or more of the UV, IR, and visible ranges of the spectrum.

8. The printing system of claim 6, wherein the radiation generating elements include light emitting diodes or laser diodes.

9. The printing system of claim 1, wherein the secondary fusing system includes a first contacting member and a second contacting member, the first and second contacting members defining a nip therebetween for receiving the printed media therethrough and a source of radiation spaced from the nip by the first contacting member.

10. The printing system of claim 9, wherein the first contacting member is transmissible to radiation emitted by the source of radiation.

11. The printing system of claim 1, further comprising a sensor which senses a fusing characteristic of the printed media or a property of the image related to a fusing characteristic, the sensor providing feedback on the sensed characteristic or property to the control system.

12. The printing system of claim 11, wherein the sensor comprises an appearance sensor which detects a gloss level of an image on the printed media.

13. The printing system of claim 1, wherein the secondary fusing device comprises a plurality of secondary fusing devices.

14. The printing system of claim 1, wherein an intensity of a radiation output of the selectively addressable energy generating elements is variable.

15. The printing system of claim 1, wherein the secondary fusing device is adapted for forming an area of a different gloss of a preselected shape on the printed media.

16. The printing system of claim 3, wherein the at least one marking device is connected with the secondary fusing device by a print media transporting system.

17. The printing system of claim 3, wherein the control system includes an algorithm for evaluating the printed media from the at least one marking device based on at least one of:

properties of the print media which influence primary fusing of the image;

a process speed of the marking device;

a desired fusing characteristic to be achieved;

non-uniformity of the primary fusing device in one or more of a direction perpendicular to a direction of flow of the print media and a direction parallel to a direction of flow of the print media;

combined effects of multiple marking devices which mark the same printed media;

effects of toner selection;

effects of toner pile height; and a sensed fusing characteristic of the printed media.

18. A printing system comprising:

at least one marking device for applying toner images to print media, each of the marking devices including a primary fusing device for applying a primary fusing treatment to the applied toner images exiting the at least one marking device to at least tack the toner images to the print media and at least partially fuse a toner forming the toner images;

a secondary fusing device which receives printed media from the at least one marking device and selectively applies a further fusing treatment to further fuse the toner forming the applied toner images thereon, the secondary fusing device including an array of selectively addressable energy generating elements;

a media handling system which transports printed media to which the first fusing treatment has been applied along a paper path from the each of the marking devices to the secondary fusing device; and a control system operably coupled with the secondary fusing device, and wherein the control system independently controls selected ones of the energy generating elements whereby a selected portion of the toner of an applied image receives a further fusing treatment which is different from a further fusing treatment received by a second portion of the toner forming the applied image to modify the fusing characteristics of less than an entire image, the fusing characteristic comprising at least one of degree of fixing and level of gloss.

19. A method of printing comprising:

applying an image to print media;

with a first fusing device, applying a primary fusing treatment to the applied image to form printed media to at least tack toner in the image to the print media;

transporting the printed media from the first fusing device to a secondary fusing device;

applying a secondary fusing treatment with the secondary fusing device to the printed media, the secondary fusing treatment including:

selectively addressing a plurality of independently addressable energy generating elements which form an array of independently addressable energy generating elements to apply more heat to a first portion of the image than to a second portion of the image whereby a difference between a gloss level of the first portion of the applied image and a gloss level of the second portion of the applied image is reduced, and the primary fusing treatment including a blanket fusing treatment.

20. The method of claim 19, further comprising:

evaluating whether primary fusing treatment has achieved preselected fusing characteristics for the printed media; and where the primary fusing treatment has not achieved the preselected fusing characteristics, selectively actuating the selectively addressable energy generating elements to achieve the achieved preselected fusing characteristics.

21. The method of claim 20, wherein the evaluation comprises comparing a fusing characteristic achieved in the primary fusing treatment with a desired fusing characteristic.

22. The method of claim 20, wherein the evaluation comprises accessing an algorithm which stores one or more relationships which affect whether the printed media is only partially fused.

23. The method of claim 22, wherein the one or more relationships are selected from:

a relationship between a property of the print media and fusing of the image;

a relationship between a process speed of the primary fusing treatment and fusing of the image;

a relationship between a non-uniformity of the primary fusing treatment in a direction perpendicular to a direction of flow of the print media and fusing of the image;

a relationship between a combined effects of multiple primary fusing treatments which treat the same printed media and fusing of the image;

a relationship between an ink selection and fusing of the image;

a relationship between toner pile height and fusing of the image; and a sensed fusing characteristic of the printed media.

24. The method of claim 19, wherein selectively addressing the independently addressable energy generating elements effects a modification of a fusing characteristic of a selected portion of the applied image, relative to another portion of the applied image.

25. The method of claim 19, wherein selectively addressing a plurality of independently addressable energy generating elements includes at least one of:

applying power to fewer than all of the addressable energy generating elements; and varying an intensity of a radiation output from selected ones of the addressable energy generating elements.

26. A method of printing comprising:

applying an image to print media;

with a first fusing device, applying a primary fusing treatment to the applied image to form printed media, the first fusing treatment serving to at least tack the applied image to the print media;

evaluating whether the primary fusing treatment has achieved gloss uniformity for the printed media; and where the primary fusing treatment has not achieved the preselected gloss uniformity, with a second fusing device, applying a secondary fusing treatment to a selected region of the printed media to increase a gloss uniformity of the applied and fused image, including:

selectively addressing a plurality of independently addressable energy generating elements.

* * * * *